US009494900B2

(12) United States Patent
Utsunomiya et al.

(10) Patent No.: US 9,494,900 B2
(45) Date of Patent: Nov. 15, 2016

(54) FIXING DEVICE AND IMAGE FORMING APPARATUS INCLUDING A NIP-FORMING-MEMBER SUPPORTED BY AT LEAST TWO PLATES JOINED TOGETHER

(71) Applicants: Kohichi Utsunomiya, Kanagawa (JP); Hideo Nagafuji, Kanagawa (JP); (Continued)

(72) Inventors: Kohichi Utsunomiya, Kanagawa (JP); Hideo Nagafuji, Kanagawa (JP); (Continued)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/790,297

(22) Filed: Jul. 2, 2015

(65) Prior Publication Data

US 2016/0011548 A1 Jan. 14, 2016

(30) Foreign Application Priority Data

Jul. 10, 2014 (JP) ..... 2014-142602

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01); *G03G 15/2042* (2013.01); *G03G 2215/2035* (2013.01)

(58) Field of Classification Search
CPC ..... G03G 15/2017; G03G 2215/2035
(Continued)

(56) References Cited

U.S. PATENT DOCUMENTS 7,437,110 B2 10/2008 Kondo et al.
8,010,028 B2 8/2011 Shinshi
(Continued)

FOREIGN PATENT DOCUMENTS

JP 2007-233011 9/2007
JP 2007-334205 12/2007

OTHER PUBLICATIONS

U.S. Appl. No. 14/790,297, filed Jul. 2, 2015.
(Continued)

*Primary Examiner* — Billy Lactaoen
*Assistant Examiner* — Arlene Heredia Ocasio
(74) *Attorney, Agent, or Firm* — Oblon, McClelland, Maier & Neustadt, L.L.P.

(57) ABSTRACT

A device includes a fixing belt, a holder that holds the fixing belt, a pressing member that comes in contact with the fixing belt, a nip-forming-member arranged inside the fixing belt, that forms a nip by coming in contact with the pressing member, a supporting member that supports the nip-forming-member, a side plate to which the nip-forming-member and the supporting member are fixed, and a pressing mechanism that presses a pressing roller to the nip-forming-member via the fixing belt. The supporting member includes at least two plates. The two plates are separated from each other near a contact portion where the plates come in contact with the nip-forming-member. At least a part of each of the plates is a flat surface parallel to a direction of a load applied by the pressing mechanism. Portions of the two plates on a side distant from the contact portion are joined together.

12 Claims, 10 Drawing Sheets

(71) Applicants: Yuji Arai, Kanagawa (JP); Arinobu Yoshiura, Kanagawa (JP); Qifeng Cui, Tokyo (JP); Shohei Saito, Kanagawa (JP); Yutaka Ikebuchi, Kanagawa (JP); Motoyoshi Yamano, Kanagawa (JP)

(72) Inventors: Yuji Arai, Kanagawa (JP); Arinobu Yoshiura, Kanagawa (JP); Qifeng Cui, Tokyo (JP); Shohei Saito, Kanagawa (JP); Yutaka Ikebuchi, Kanagawa (JP); Motoyoshi Yamano, Kanagawa (JP)

(58) Field of Classification Search
USPC ..... 399/329
See application file for complete search history.

(56) References Cited

U.S. PATENT DOCUMENTS

2010/0290822 A1 11/2010 Hasegawa et al.
2011/0058866 A1 3/2011 Ishii et al.
2011/0076071 A1 3/2011 Yamaguchi et al.
2011/0116848 A1* 5/2011 Yamaguchi et al. ..... G03G 15/2064 399/329
2011/0129268 A1 6/2011 Ishii et al.
2011/0194870 A1 8/2011 Hase et al.
2011/0200368 A1 8/2011 Yamaguchi et al.
2011/0206427 A1 8/2011 Iwaya et al.
2011/0217093 A1 9/2011 Tokuda et al.
2011/0217095 A1 9/2011 Ishii et al.
2011/0222888 A1 9/2011 Ikebuchi et al.
2011/0222929 A1 9/2011 Fujimoto et al.
2011/0222930 A1 9/2011 Fujimoto et al.
2011/0229181 A1 9/2011 Iwaya et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0262193 A1* 10/2011 Kimura ..... G03G 15/2064 399/329
2011/0274453 A1 11/2011 Shimokawa et al.
2012/0121305 A1 5/2012 Yoshikawa et al.
2012/0155936 A1 6/2012 Yamaguchi et al.
2012/0177423 A1 7/2012 Imada et al.
2013/0045032 A1* 2/2013 Shimokawa et al. ..... G03G 15/2053 399/329
2013/0170879 A1 7/2013 Yoshinaga et al.
2013/0170880 A1 7/2013 Gotoh et al.
2013/0183071 A1* 7/2013 Iwaya et al. ..... G03G 15/2053 399/329
2013/0195493 A1 8/2013 Hase et al.
2013/0209125 A1 8/2013 Uchitani et al.
2013/0251390 A1 9/2013 Ishii et al.
2013/0322937 A1* 12/2013 Suzuki et al. ..... G03G 15/2003 399/329
2014/0064804 A1 3/2014 Yamaguchi et al.
2014/0072355 A1 3/2014 Tamaki et al.
2014/0079424 A1 3/2014 Ikebuchi et al.
2014/0079453 A1 3/2014 Arai et al.
2014/0079455 A1* 3/2014 Seki et al. ..... G03G 15/2053 399/329
2014/0186077 A1* 7/2014 Lee et al. ..... G03G 15/2017 399/329
2014/0248072 A1 9/2014 Yoshinaga et al.
2014/0270820 A1 9/2014 Saito et al.
2014/0270832 A1 9/2014 Saito et al.
2014/0270833 A1 9/2014 Yuasa et al.
2014/0270872 A1 9/2014 Tamaki et al.
2015/0063884 A1 3/2015 Iwaya et al.
2015/0093168 A1* 4/2015 Hiramatsu ..... G03G 15/2064 399/329

OTHER PUBLICATIONS

U.S. Appl. No. 14/657,656, filed Mar. 13, 2015.
U.S. Appl. No. 14/644,903, filed Mar. 11, 2015.
U.S. Appl. No. 14/792,870, filed Jul. 7, 2015.
U.S. Appl. No. 14/793,949, filed Jul. 8, 2015.

* cited by examiner

FIXING DEVICE AND IMAGE FORMING APPARATUS INCLUDING A NIP-FORMING-MEMBER SUPPORTED BY AT LEAST TWO PLATES JOINED TOGETHER

CROSS-REFERENCE TO RELATED APPLICATIONS

The present application claims priority to and incorporates by reference the entire contents of Japanese Patent Application No. 2014-142602 filed in Japan on Jul. 10, 2014.

BACKGROUND OF THE INVENTION

1. Field of the Invention

The present invention relates to a fixing device used in an image forming apparatus, such as a copier, a printer, or a facsimile machine, and an image forming apparatus including the fixing device.

2. Description of the Related Art

In recent years, an image forming apparatus, such as a copier, a printer, or a facsimile machine, forms images through an image forming process, such as electrophotography recording, electrostatic recording, or magnetic recording, and forms unfixed toner images on recording materials, such as recording material sheets, printing paper, photosensitive paper, or dielectric-coated paper, by an image transfer method or a direct method. Well-known examples of the fixing device for fixing an unfixed toner image include a device that performs a fixing process by applying heat and pressure to a toner image formed on a recording sheet at a nip between an endless belt and a pressing roller.

As the fixing device as described above, a belt fixing device is known. For example, as illustrated in FIG. 12, a fixing belt 103 is extended between a fixing roller 102 and a heating roller 104 in which a built-in heater 105 is provided, and a pressing roller 101 is pressed against the fixing roller 102 via the fixing belt 103 to form a fixing nip. A tension applying unit 107 applies tension to the fixing belt 103, a separation claw 106 is provided to separate a recording sheet P from the fixing belt 103 after fixing, and a thermistor 110 detects a temperature of the fixing belt 103 on the heating roller 104 side.

Incidentally, in recent years, there is a need to further reduce a warm-up time (a time needed until a predetermined temperature (reload temperature) that enables printing is reached from a room temperature at the time of power activation), or a first print time (a time needed until printing operation is performed through printing preparation and ejection of a sheet is complete upon reception of a print request). Further, with an increase in the speed of the image forming apparatus, the number of sheets to be fed per unit time increases, in particular, a necessary amount of heat increases, so that the amount of heat may become insufficient especially at the beginning of continuous printing (so-called temperature drop). However, the conventional belt fixing device is unable to sufficiently cope with this issue.

Therefore, a fixing device using a pipe-shaped metallic heat conductor has been proposed, in which a pipe-shaped metallic heat conductor is arranged inside an endless belt and the inner side of the metallic heat conductor is heated by a heat source to heat the entire belt with convection, radiation heat, or heat conduction in air between the endless belt and the metallic heat conductor. The fixing device using the pipe-shaped metallic heat conductor is disclosed in, for example, Japanese Laid-open Patent Publication No. 2007-334205.

The fixing device as described above further includes a pressing roller that comes in contact with the metallic heat conductor via the endless belt to form a nip portion, and the endless belt is moved in a circumferential direction with respect to the fixed metallic heat conductor along with rotation of the pressing roller. This configuration makes it possible to heat the entire endless belt included in the fixing device, reduce the first print time from a heating standby state, and resolve a shortage of heat at the time of high-speed rotation.

Further, Japanese Laid-open Patent Publication No. 2007-233011 discloses an example of a fixing device that includes, on the inside of an endless belt, only a nip forming member having a sliding surface that comes in sliding contact with the endless belt, a backup member that is located on the side opposite to the sliding surface of the nip forming member and that supports the nip forming member, and a heat source.

In this example, a pressing roller is provided that forms a nip portion between itself and the sliding surface of the nip forming member to nip and press the endless belt and that causes the endless belt to rotate in a predetermined direction. In the fixing device, it is possible to reduce a heat capacity around the heat source. Further, the heat source directly heats the endless belt and the nip is formed at the heated region, so that it is possible to reduce a first print time from a heating standby state.

Incidentally, as described in Japanese Laid-open Patent Publication No. 2007-233011, in the fixing device that includes, on the inside of the endless belt, the nip forming member having the sliding surface that comes in sliding contact with an inner surface of the endless belt and having the backup member that supports the nip forming member, the backup member needs to penetrate through the belt. In this case, the nip supporting member serving as the backup member for receiving a load transmitted from the pressing roller via the nip forming member functions as a doubly-supported beam that supports the received load at both ends.

The nip supporting member serving as the backup member that functions as the doubly-supported beam needs to support a load received from the pressing roller and to form a nip width with high accuracy, so that the nip supporting member needs to have a predetermined volume to ensure the rigidity in order to maintain the strength as much as possible.

However, it is preferable to reduce the volume of the nip supporting member as much as possible in order to downsize the fixing device and reduce an extra heat capacity. In this regard, however, if the strength of the nip supporting member is reduced with reduction of the volume, the center of the nip supporting member including the sliding surface may be deflected in a direction away from the nip surface, so that the uniform nip width in the longitudinal direction may not be obtained.

Therefore, as a method of reducing the volume of the nip supporting member while maintaining the strength of the nip supporting member as much as possible, a method of forming the nip supporting member in a box shape may be applicable, for example. However, if a shape formed by simply bending a plate into a box shape is employed, it is difficult to ensure the dimensional accuracy of the nip supporting member, so that it is difficult to accurately determine a fixing nip position.

As descried above, the endless belt of the fixing device includes, on the inside thereof, the nip supporting member serving as a doubly-supported beam that supports a load applied from a pressing member, such as the pressing roller, via the nip forming member. In this case, there is a need to make a structure, in which the nip supporting member has an adequate strength, in which the volume of the nip supporting member is reduced, and in which the uniform nip width in the longitudinal direction as the dimensional accuracy of the supported nip forming member can easily be ensured.

Namely, in view of the above-described conventional arts, there is a need to provide a fixing device and an image forming apparatus configured such that the dimensional accuracy of a nip supporting member, which supports a nip forming member forming a fixing nip with an opposing pressing member and which determines a nip position, can easily be ensured to stabilize a nip width.

SUMMARY OF THE INVENTION

It is an object of the present invention to at least partially solve the problems in the conventional technology.

According to the present invention, there is provided a fixing device comprising: an endless fixing belt; a fixing belt holder that holds both ends of the fixing belt; a pressing member that comes in contact with an outer circumferential surface of the fixing belt; a nip forming member that is arranged inside the fixing belt, and forms a nip by coming in contact with the pressing member via the fixing belt; a nip supporting member that supports the nip forming member; a side plate to which the fixing belt holder and the nip supporting member are fixed; and a pressing mechanism that presses the pressing member against the nip forming member via the fixing belt, wherein the nip supporting member includes at least two plates, the two plates are separated from each other near a contact portion where the two plates come in contact with the nip forming member, at least a part of each of the two plates is a flat surface parallel to a direction of a load applied by the pressing mechanism, and portions of the two plates on a side distant from the contact portion are joined together.

The present invention also provides an image forming apparatus comprising the above-described fixing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image forming apparatus according to the present invention will be described.

A feature of the disclosed technology lies in a fixing device used in an image forming apparatus that forms images through an electrophotography process including processes of charging, exposure, developing, transfer, and fixing, which will be described below. Specifically, a nip supporting member supports a nip forming member that forms a nip by contact with a pressing member across a fixing belt. The nip supporting member is configured to easily prevent positional deviation due to a load from the pressing member, so that the dimensional accuracy can easily be ensured to keep a nip width in a short-side direction of the nip forming member constant along a longitudinal direction of the nip forming member while maintaining a strength.

In the embodiments and modifications described below, components, such as parts or constituent parts, with the same functions or the same shapes are denoted by the same reference signs wherever possible, and the same explanation will not be repeated.

Figure 1:
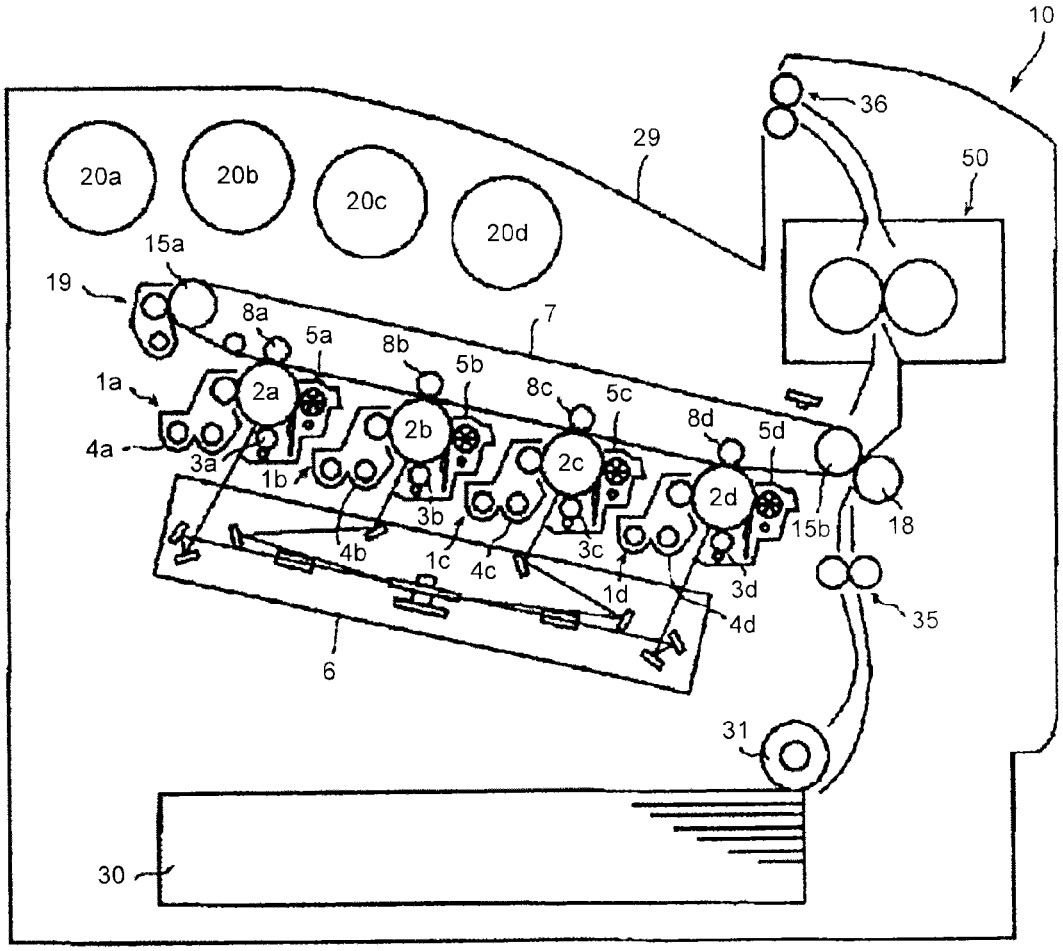
FIG. 1 is a configuration diagram schematically illustrating an image forming apparatus that is a color printer including a fixing device according to an embodiment of the present invention.

FIG. 1 is a schematic cross-sectional view illustrating an example of an image forming apparatus as a color printer that includes a fixing device according to an embodiment of the present invention. An image forming apparatus 10 described here includes a fixing device 50 to be described later and an electrophotography image forming unit. The image forming unit includes a plurality of (four in the illustrated example) image forming devices 1*a*, 1*b*, 1*c*, and 1*d*. The first to the fourth image forming devices 1*a* to 1*d* have the same configurations except for colors of corresponding toner. Therefore, for example, a black toner image, a magenta toner image, a cyan toner image, and a yellow toner image are formed in the respective image forming devices. Meanwhile, the image forming devices have the same configurations except for the colors of corresponding developer (toner); therefore, in the explanation below, letters a, b, c, and d added to the reference signs will be omitted appropriately.

Each of the image forming devices 1 includes a drum-shaped photoconductor 2 as an electrostatic latent image bearer, and includes a charging device 3, a developing device 4, and a cleaning device 5, which are arranged around the photoconductor 2. The photoconductor 2 can rotate clockwise, and the charging device 3 is pressed against the surface of the photoconductor 2. The charging device 3 is driven to rotate with rotation of the photoconductor 2. A high-voltage power supply (not illustrated) applies a predetermined bias voltage to each of the charging devices 3 to uniformly charge the surface of the photoconductor 2 being rotated. While the charging device 3 described here is a roller-shaped member that comes in contact with the photoconductor 2, a contactless member using a corona discharge or the like may be employed.

Further, the image forming apparatus 10 illustrated in FIG. 1 includes an exposure device 6 arranged obliquely below and parallel to the four image forming devices. The exposure device 6 appropriately includes appropriate components, such as a light source, a polygon mirror, an f-θ lens, or a reflecting mirror. The exposure device 6 exposes each of the photoconductors 2 charged by the charging devices 3, on the basis of image information generated according to image data on toner of each of the colors. The exposure device 6 is provided to form an electrostatic latent image on each of the photoconductors 2. The electrostatic latent images formed on the photoconductors 2 by the exposure device 6 are developed into visible images with toner of the respective colors attached thereto when passing by the developing device 4 along with the rotation of the photoconductors 2. Meanwhile, toner bottles 20*a*, 20*b*, 20*c*, and 20*d* filled with toner of the respective colors of black, magenta, cyan, and yellow are arranged in the upper part inside the image forming apparatus 10. A predetermined supply amounts of toner of the respective colors are supplied from the toner bottles 20*a*, 20*b*, 20*c*, and 20*d* to the developing devices 4*a*, 4*b*, 4*c*, and 4*d* of the respective colors through conveying paths (not illustrated).

Further, an endless-belt-shaped intermediate transfer belt 7 configured as an intermediate transfer body is arranged so as to face each of the photoconductors 2 of the image forming devices, and each of the photoconductors 2 is in contact with the surface of the intermediate transfer belt 7. The intermediate transfer belt 7 illustrated in FIG. 1 is looped over a plurality of supporting rollers (for example, supporting rollers 15*a* and 15*b*). In the illustrated example, the supporting roller 15*a* is coupled to a driving motor serving as a drive source (not illustrated). By driving the driving motor, the intermediate transfer belt 7 moves to rotate counterclockwise in the figure, and causes the supporting roller 15*b*, which can be driven to rotate by the rotation, to rotate. Primary transfer rollers 8 are arranged on the inner side of the intermediate transfer belt 7 so as to face the photoconductors 2 across the intermediate transfer belt 7. A high-voltage power supply (not illustrated) applies primary transfer biases to the primary transfer rollers 8, so that toner images developed into visible images by the developing device 4 are primarily transferred to the intermediate transfer belt 7. An intermediate transfer belt cleaning device 19 removes primary-transfer residual toner remaining on the photoconductors 2 without having been primarily transferred, for preparation for next image formation on the photoconductors 2, so that toner on the photoconductors 2 is fully removed.

Furthermore, in the image forming apparatus 10 illustrated in the figure, a secondary transfer roller 18 as a secondary transfer device is provided on a downstream side of the primary transfer rollers 8 in the driving direction of the intermediate transfer belt 7. The secondary transfer roller 18 faces the supporting roller 15*b* across the intermediate transfer belt 7. The secondary transfer roller 18 and the supporting roller 15*b* form a secondary transfer nip portion across the intermediate transfer belt 7. The image forming apparatus 10 further includes a paper feeding cassette 30 as a recording medium stacking unit, a feeding roller 31, a registration roller pair (positioning roller pair) 35, and the like. Furthermore, the fixing device 50 and a paper ejection roller pair 36 are provided on the downstream side of the secondary transfer roller 18 in a recording medium conveying direction.

Next, image forming operation will be described. In the image forming operation, configurations to form toner images on the respective photoconductors 2 and transfer the toner images to the intermediate transfer belt 7 are substantially the same in all of the image forming devices except for colors of the toner images; therefore, letters a, b, c, and d will be omitted appropriately.

Each of the above-described photoconductors 2 is first driven to rotate clockwise by a drive source (not illustrated), and at this time, the surface of the photoconductor is irradiated with light from a neutralizing device (not illustrated) to initialize a surface potential. The charging device 3 uniformly charges the surface of the photoconductor 2, the surface potential of which has been initialized, to a predetermined polarity. The exposure device 6 irradiates the charged surface of the photoconductor with light, so that an electrostatic latent image is formed on the surface of the photoconductor. At this time, image information exposed on each of the photoconductors 2 is a piece of image information on a single color and is obtained by decomposing a desired full-color image into pieces of information on the respective toner colors of yellow, cyan, magenta, and black. The electrostatic latent images formed on the photoconductors are developed into visible toner images with toner (developer) of the respective colors applied by the developing device 4 when passing by the developing device 4.

The intermediate transfer belt 7 is driven to move counterclockwise in the figure. A primary transfer voltage with a polarity opposite to the toner charging polarity of the toner images formed on the photoconductors is applied to each of the primary transfer rollers 8. Therefore, a transfer electric field is formed between each of the photoconductors 2 and the intermediate transfer belt 7. The toner images on the photoconductors 2 are electrostatically transferred by primary transfer to the intermediate transfer belt 7 that is driven to rotate in synchronization with the photoconductors 2. The primary-transferred toner images of the respective colors are sequentially superimposed on the intermediate transfer belt 7 in a timely manner from the upstream side in the conveying direction of the intermediate transfer belt 7, so that a desired full-color image is formed.

Meanwhile, a recording medium on which an image is to be formed is fed from a bundle of recording media stacked in the paper feeding cassette 30 to the registration roller pair 35 while being separated one by one by appropriate operation of an appropriate conveying member, such as the feeding roller 31. In this stage, a leading end of the conveyed recording medium hits a nip portion of the registration roller pair 35 that has not started to rotate, and forms what is called a loop. Thus, registration of the recording medium is performed.

Thereafter, the registration roller pair 35 starts to rotate at a timing synchronized with the full-color toner image borne on the intermediate transfer belt 7. Then, the recording medium is conveyed toward the secondary transfer nip portion formed by the supporting roller 15*b* and the secondary transfer roller 18 facing each other across the intermediate transfer belt 7. In the embodiment, a transfer voltage with a polarity opposite to the toner charging polarity of the toner images on the surface of the intermediate transfer belt is applied to the secondary transfer roller 18. Accordingly, the full-color toner image formed on the surface of the intermediate transfer belt 7 is collectively transferred to the recording medium.

The recording medium on which the toner image has been transferred is further conveyed to the fixing device 50. When the recording medium passes through the fixing device 50, heat and pressure are applied, so that the toner image is fixed as a permanent image to the recording medium. The image forming operation is completed when the recording medium on which the image has been fixed through image formation is discharged to a recording medium discharge unit, such as an ejection tray 29, through the paper ejection roller pair 36. Residual toner remaining on the intermediate transfer belt 7 without having been transferred at the secondary transfer nip portion, at which the secondary transfer roller 18 is arranged, is removed and collected by the intermediate transfer belt cleaning device 19.

Next, a configuration of the fixing device 50 will be described with reference to FIG. 2.

The fixing device 50 includes a fixing belt 60 as a rotatable fixing member, holders 51 as fixing belt holding members that hold both ends of the fixing belt 60, and a pressing roller 70 as a pressing member rotatably provided so as to come in contact with an outer surface of the fixing belt 60. The fixing belt 60 further includes, inside thereof, a halogen heater 61 as a heat source that heats the fixing belt 60 (see FIGS. 5A and 5B), a pad 80 as a nip forming member disposed so as to face the pressing roller 70, and a supporting member 90 as a nip supporting member that supports the pad 80. The fixing device 50 further includes side plates 52, to which the holders 51 and the supporting member 90 are fixed, a temperature sensor (not illustrated) as a temperature detecting unit that detects a temperature of the fixing belt 60, and a biasing unit (not illustrated) that biases the pressing roller 70 toward the fixing belt 60 to form a nip surface N.

The fixing belt 60 is configured by a thin and flexible endless belt member (examples of which include a film). More specifically, the fixing belt 60 is formed of a base material made of a metal material, such as nickel or stainless steel (SUS), or formed of a resin material, such as polyimide (PI), on the inner circumferential side. Further, the fixing belt 60 is formed of a release layer made of tetrafluoroethylene-perfluoroalkylvinylether copolymer (PFA), polytetrafluoroethylene (PTFE), or the like on the outer circumferential side. Further, an elastic layer made of a rubber material, such as silicone rubber, expandable silicone rubber, or fluoro-rubber, may be interposed between the base material and the release layer.

The pressing roller 70 includes a cored bar 72, an elastic layer 71 provided on the surface of the cored bar 72 and made of expandable silicone rubber, silicone rubber, fluoro-rubber, or the like, and a release layer (not illustrated) made of PFA, PTFE, or the like. The pressing roller 70 is biased toward the fixing belt 60 by the biasing unit (not illustrated) and abuts the pad 80 serving as the nip forming member via the fixing belt 60. At a position at which the pressing roller 70 and the fixing belt 60 are pressed against each other, the elastic layer 71 of the pressing roller 70 is compressed so that a nip (nip portion) N with a predetermined width n in a short-side direction of the pad 80 is formed as illustrated in FIG. 2.

The nip N is continuously formed in a longitudinal direction of the pad 80 (a direction normal to the sheet of the figure). Further, the pressing roller 70 is driven to rotate by a drive source (not illustrated), such as a motor, provided in the main body of the printer. When the pressing roller 70 rotates, the drive force is transmitted to the fixing belt 60 at the nip N, so that the fixing belt 60 is driven to rotate by the rotation.

While a solid roller is reemployed as the pressing roller 70 in the embodiment, a hollow roller may be employed. In this case, a heat source, such as a halogen heater, may be disposed inside the pressing roller 10. If an elastic layer is not provided, the heat capacity is reduced and the fixing quality can be improved. However, when unfixed toner is compressed to be fixed, minute irregularities of the surface of the belt may be transferred to an image and uneven glossiness may occur in a solid image part. To prevent this, it is preferable to provide an elastic layer with a thickness of at least 100 μm. By providing an elastic layer with a thickness of at least 100 μm, it becomes possible to smooth out minute irregularities with the aid of elastic deformation of the elastic layer, enabling to prevent the occurrence of uneven glossiness. The elastic layer 71 may be made with solid rubber; however, if a heat source is not provided inside the pressing roller 70, sponge rubber may be used. Sponge rubber is more preferable because it enhances heat insulation and reduces heat dissipation of the fixing belt 60. Further, the fixing member and the pressing member need not necessarily be pressed against each other, and may be simply brought into contact with each other without being pressed against each other.

Figure 7:
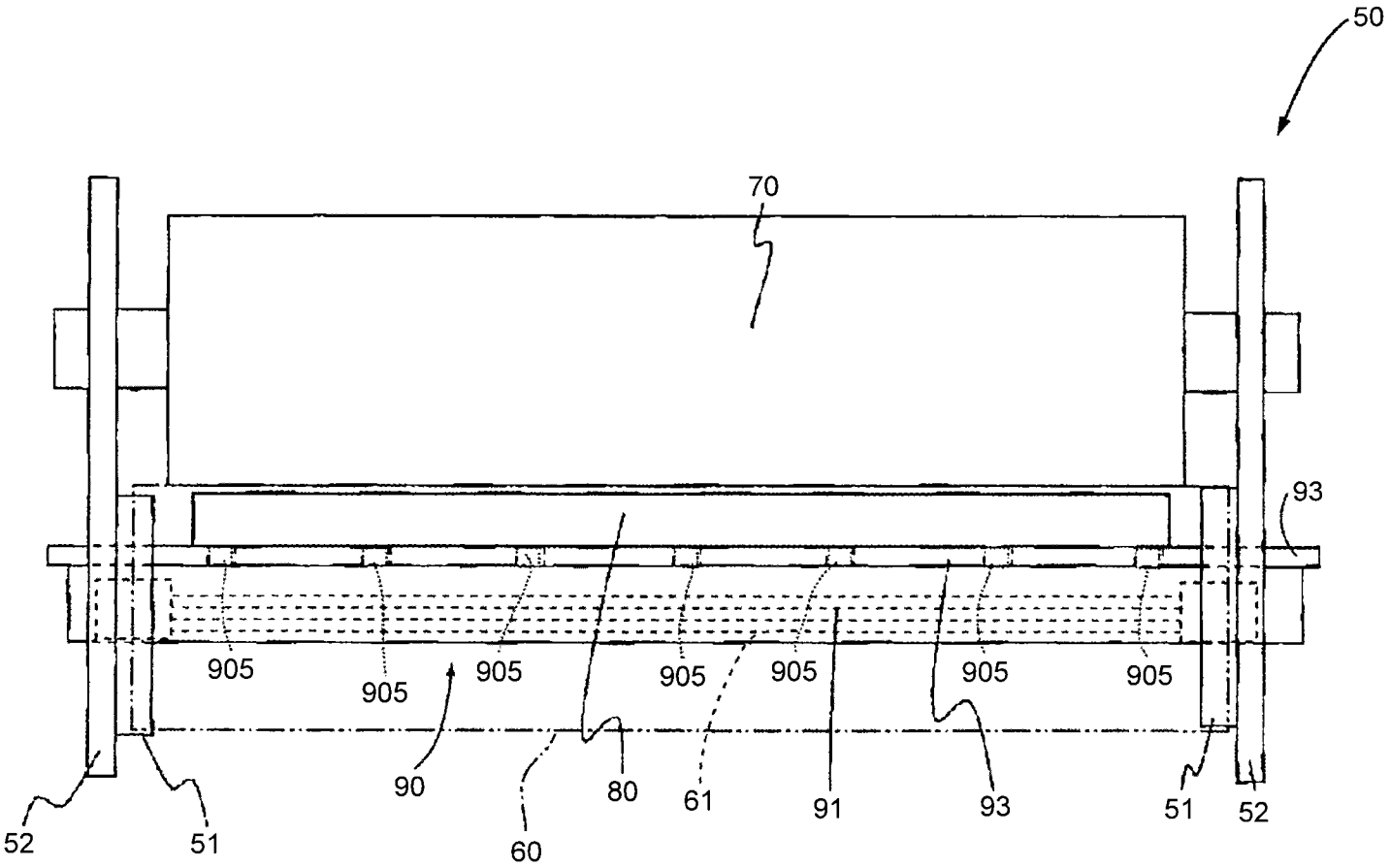
FIG. 7 is a plan view of the fixing device illustrated in FIG. 1 when a fixing belt in the main part is removed.

As illustrated in FIG. 7, the pad 80 as the nip forming member is disposed so as to longitudinally extend in a direction along a rotation axis of the fixing belt 60 or a rotation axis of the pressing roller 70, and is supported by the supporting member 90. Both ends of the supporting member 90 are engaged with and fixed to attachment holes 53 (only one side of which is illustrated in FIG. 2) that are formed on the fixed side plates 52 of a housing (not illustrated) of the fixing device. Therefore, it is possible to prevent deflection of the pad 80 and the supporting member 90 due to pressure from the pressing roller 70.

Figure 6:
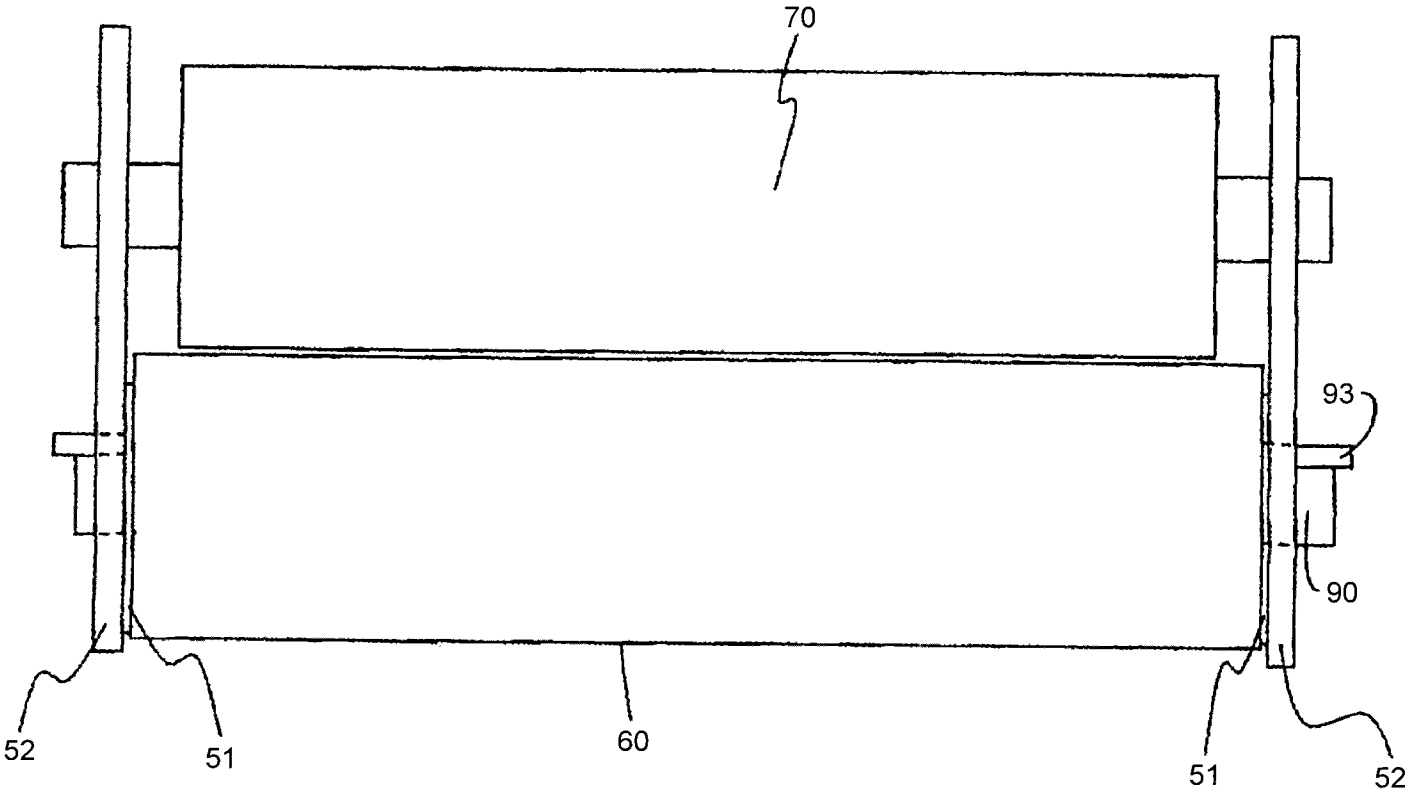
FIG. 6 is a plan view of a main part of the fixing device illustrated in FIG. 1.

Further, the holders 51 as the fixing belt holding members are formed on the respective side plates 52 (see FIGS. 6 and 7) so as to protrude toward each other. Each of the holders 51 has a curved convex part in a cutaway ring shape, and an outer curved surface comes in sliding contact with an inner wall surface of the ring-shaped fixing belt 60 on either side to prevent rotational deflection of the fixing belt 60 in a radial direction and an axial direction.

It is preferable to form the supporting member 90 with a metal material, such as stainless or iron, having a high mechanical strength, in order to fulfill a function to prevent deflection of the pad 80. In this case, it is preferable to form each of plates of the supporting member 90 by punching an iron steel plate. With use of an iron steel plate, it is possible to form the supporting member 90 with high rigidity at low cost.

The supporting member 90 will be further described later.

Figure 5A:
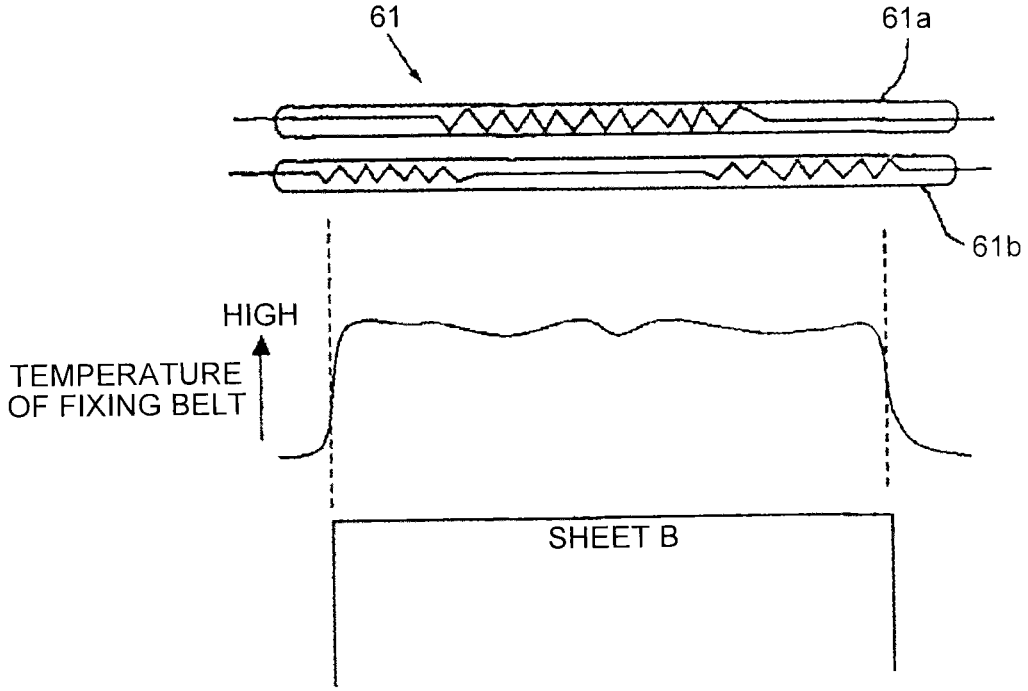
FIG. 5A is a diagram for explaining a function of a halogen lamp of the fixing device illustrated in FIG. 1, in particular, a heating range when a large-width sheet is fed.
Figure 5B:
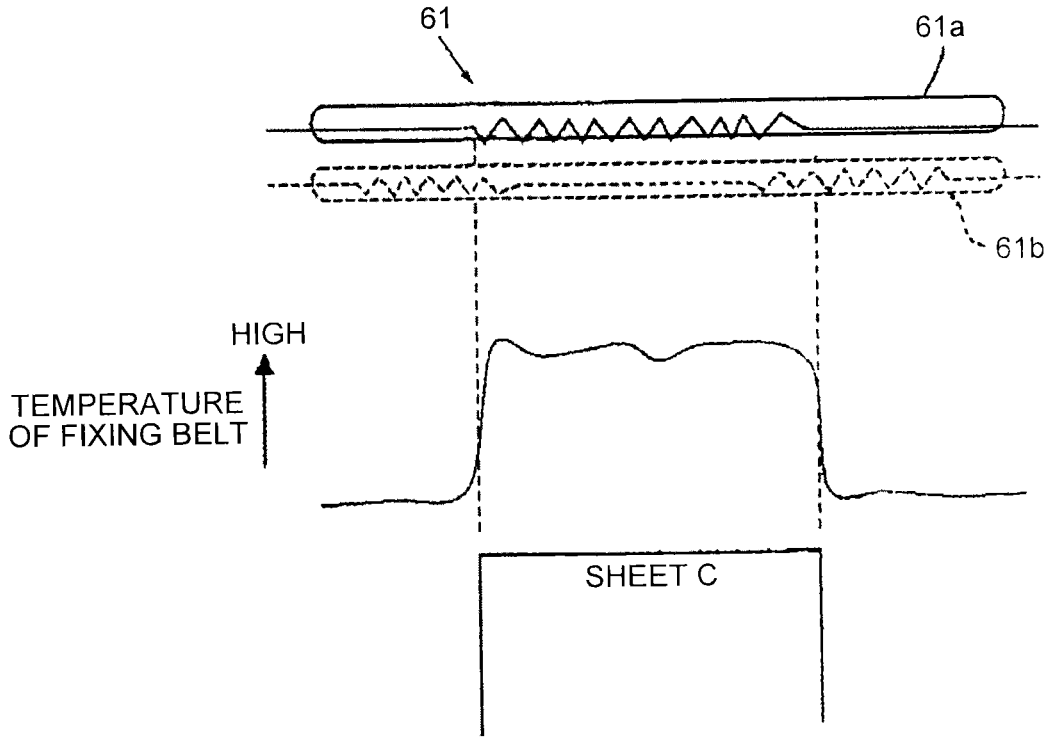
FIG. 5B is a diagram for explaining a function of the halogen lamp of the fixing device illustrated in FIG. 1, in particular, a heating range when a small-width sheet is fed.

As illustrated in FIGS. 5A and 5B, in the halogen heater 61, two heaters such as a central heater 61*a* and an end heater 61*b* are used in parallel. In the description below, the central heater 61*a* and the end heater 61*b* may be referred to as the halogen heaters 61. The halogen heaters 61 cope with different heating ranges. The halogen heaters 61 can heat the fixing belt 60 in accordance with the size of a sheet that passes through the fixing device 50.

Specifically, the fixing device 50 of the embodiment includes the following two heaters: the central heater 61*a* that heats a location corresponding to a longitudinally central region of the fixing belt 60; and the end heater 61*b* that heats locations corresponding to longitudinally end regions of the fixing belt 60. As illustrated in FIG. 5A, when a wide sheet B such as a portrait-oriented A3-size sheet is fed, both of the central heater 61*a* and the end heater 61*b* are turned on. In contrast, as illustrated in FIG. 5B, when a narrow sheet C such as a portrait-oriented A4-size sheet is fed, only the central heater 61*a* is turned on. Therefore, power consumption used for heating the fixing belt 60 can be reduced. While the two halogen heaters 61 are used in the embodiment, embodiments are not limited thereto.

The pad 80 is disposed between the fixing belt 60 and the halogen heater 61, and functions as a shielding member that partially blocks heat from the halogen heater 61 (for example, an end portion in the axial direction). Therefore, it is possible to prevent an excessive increase in a temperature of a no-sheet passing region on the fixing belt 60 particularly when sheets are continuously fed, so that it is possible to protect the fixing belt 60 from deterioration or damage due to heat. The pad 80 will be further described later.

Next, basic operation of the fixing device 50 according to the embodiment will be described.

Figure 2:
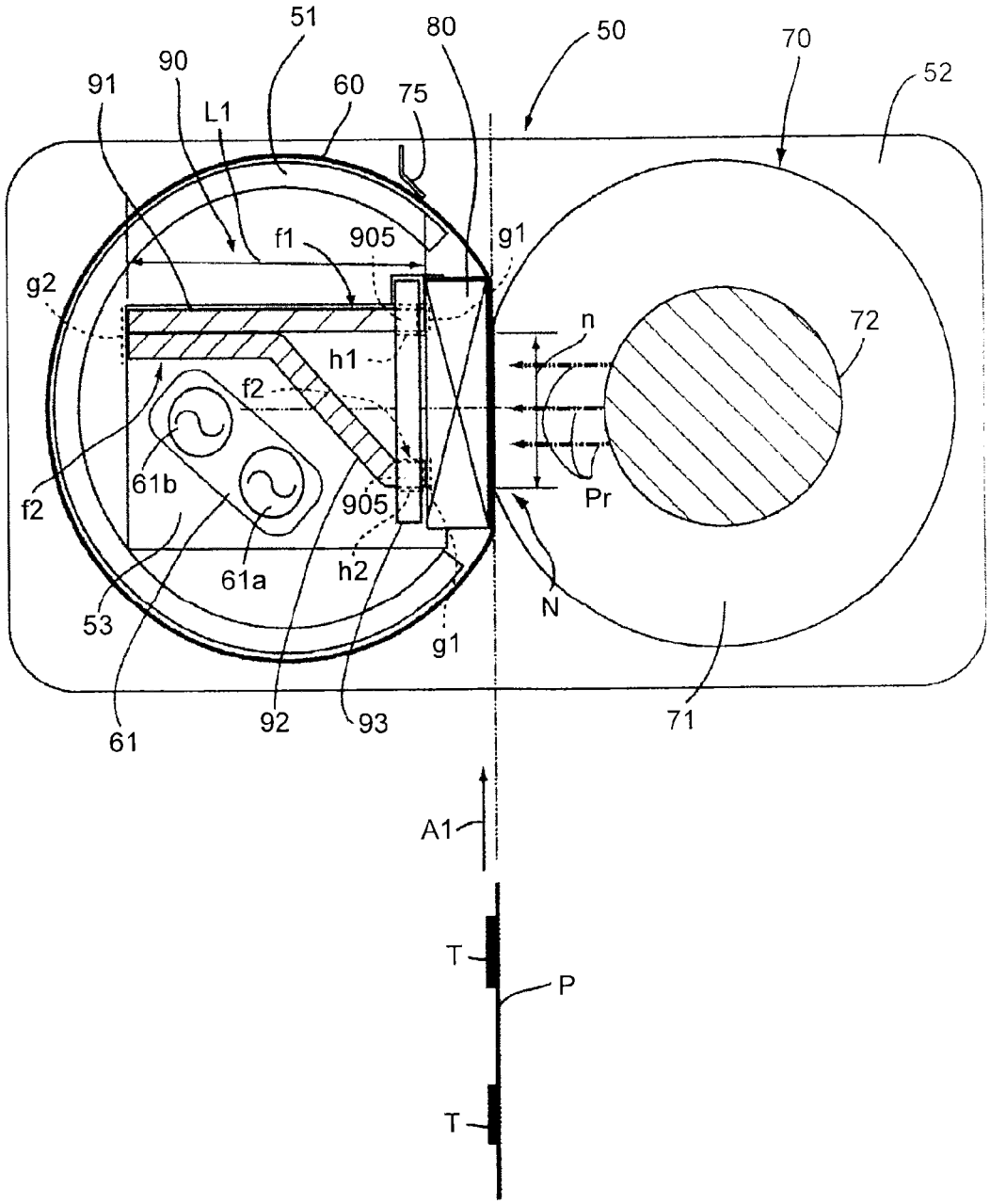
FIG. 2 is an enlarged cross-sectional view schematically illustrating the fixing device illustrated in FIG. 1.

When a power switch (not illustrated) of the main body of the printer is turned on, power is supplied to the halogen heater 61, and the pressing roller 70 starts to rotate clockwise in FIG. 2. Therefore, the fixing belt 60 is driven to rotate counterclockwise in FIG. 2 because of a frictional force against the pressing roller 70.

Thereafter, a sheet P (see FIG. 2) as an image bearer bearing an unfixed toner image T through the above-described image forming process is conveyed in a direction of an arrow A1 in FIG. 2 while being guided by a guide plate (not illustrated) and fed into the nip N between the fixing belt 60 and the pressing roller 70 pressed against each other. Subsequently, the toner image T is fixed to the surface of the sheet P by heat of the fixing belt 60 heated by the halogen heater 61 and a pressing force between the fixing belt 60 and the pressing roller 10.

The sheet P on which the toner image T has been fixed is conveyed out of the nip N in the direction of the arrow A1 in FIG. 2. In this case, a leading end of the sheet P comes in contact with a leading end of a separation member 75 supported by the side plates 52, so that the sheet P is separated from the fixing belt 60. Thereafter, the separated sheet P is discharged to the outside of the apparatus by the paper ejection roller and stocked on the paper ejection tray as described above.

Next, the pad 80 as the nip forming member supported by the supporting member 90 will be described.

Figure 3A:
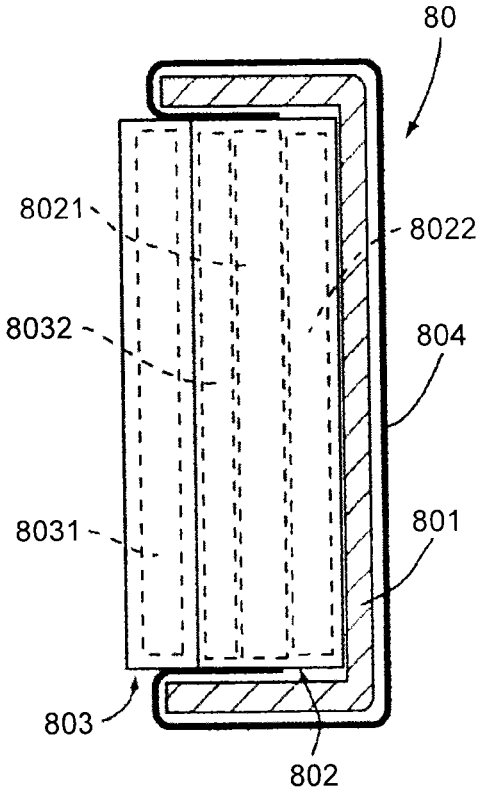
FIG. 3A is a sectional side view of a pad of the fixing device illustrated in FIG. 1.
Figure 3B:
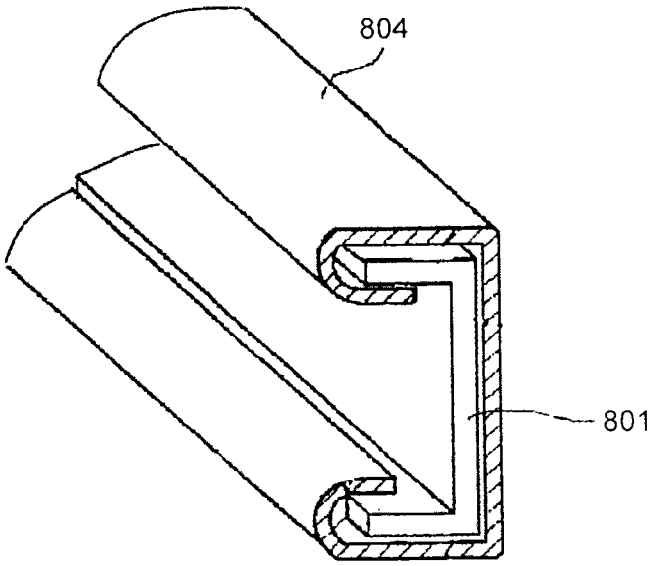
FIG. 3B is a partial cutaway perspective view of the pad of the fixing device illustrated in FIG. 1.

As illustrated in FIGS. 3A and 3B, the pad 80 has a four-layer structure, in which a front pad 801 (a first layer of a heat transfer unit), a middle pad 802 (a second layer of the heat transfer unit), a back pad 803 (a third layer of the heat transfer unit), and a sliding sheet 804 are combined.

As illustrated in FIG. 3A, the front pad 801 of the pad 80, as the first layer of the heat transfer unit, is made of metal, functions as a heat equalizing layer, and is covered by the sliding sheet 804. As illustrated in FIG. 3A, the middle pad 802 and the back pad 803 are used to nip end regions of the sliding sheet 804 in the sliding direction to tightly fix the sliding sheet 804. Therefore, when the fixing belt 60 rotates, the fixing belt 60 slides against the sliding sheet 804, so that a driving torque of the fixing belt 60 can be reduced and a load due to a frictional force against the fixing belt 60 can be reduced.

Figure 4:
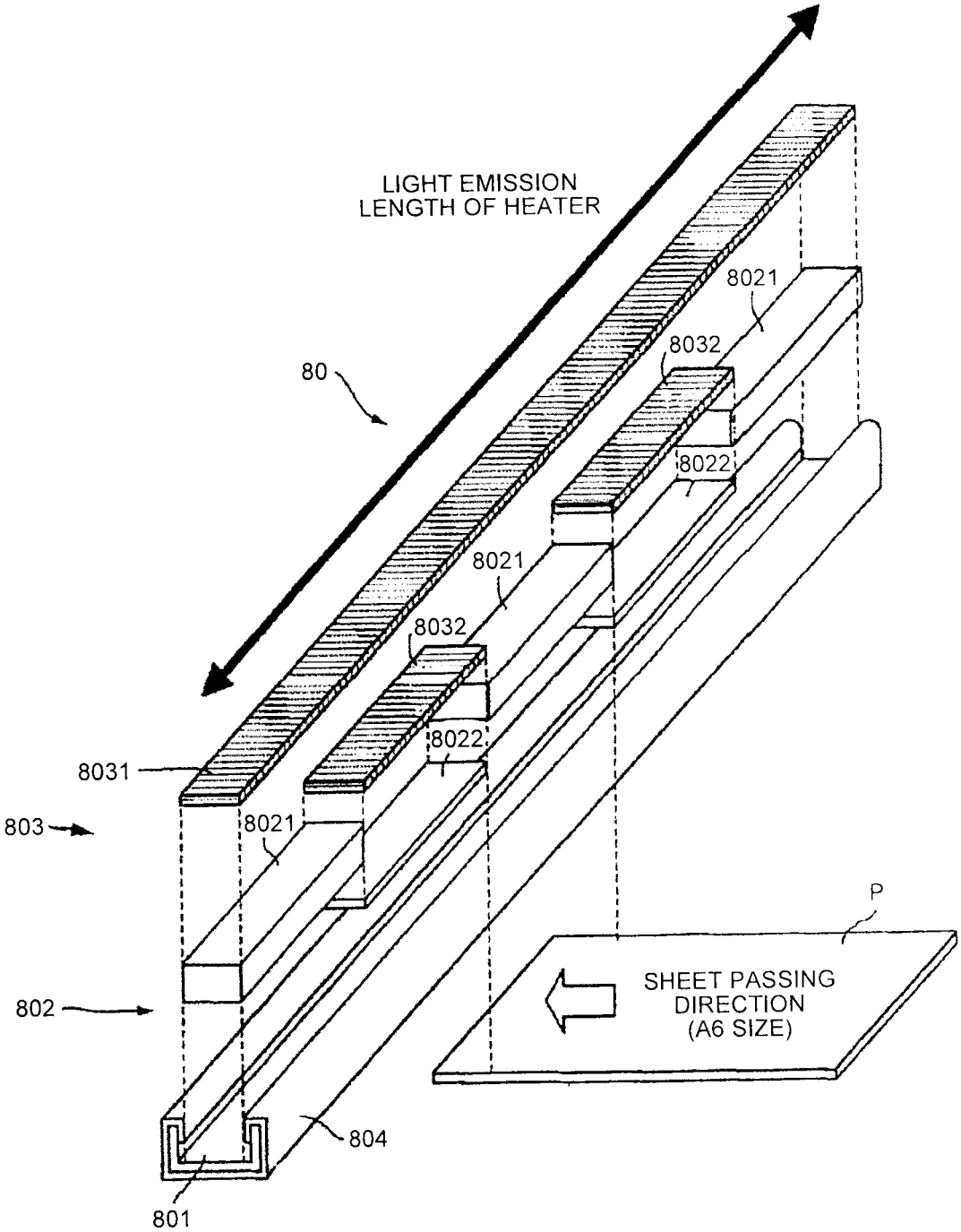
FIG. 4 is an enlarged exploded perspective view of the pad of the fixing device illustrated in FIG. 1.

As illustrated in FIG. 4, the front pad 801 of the pad 80 has a function to facilitate heat transfer in the longitudinal direction (an oblique front-back direction on the sheet of the figure) to equalize the heat of the fixing belt 60 and prevent an increase in the temperature of a no-sheet passing portion.

In contrast, the back pad 803, which is in contact with the supporting member 90 and is made of metal, includes a first heat absorbing member 8031. The first heat absorbing member 8031 is a heat absorbing layer, is preferred to have a large heat capacity or a large surface area in order to increase the amount of heat discharge, and is made of metal.

The middle pad 802 between the two layers includes second heat absorbing members 8032, first heat insulating members 8021, and second heat insulating members 8022, and functions as a heat transfer correcting layer. Each of the intermittently-disposed second heat absorbing members 8032 has a function to facilitate heat transfer in a thickness direction and to absorb heat. Namely, the first heat absorbing member 8031 compensates for a shortage of the heat capacity of the front pad 801.

The first heat insulating members 8021 at adjacent positions are made of, for example, resin with lower thermal conductivity than the front pad 801, extend partially in the longitudinal direction of the fixing belt 60, and are arranged at positions where the second heat absorbing members 8032 are not located between the front pad 801 and the first heat absorbing member 8031 (see FIG. 4). By providing the first heat insulating members 8021 as described above, it is possible to prevent excessive absorption of heat from the fixing belt 60. As a result, it is possible to prevent a temperature drop at a sheet passing portion. Further, it is possible to reduce a warm-up time and power consumption.

The second heat insulating members 8022 are made of, for example, resin with lower thermal conductivity than the front pad 801, and are arranged between the front pad 801 and the second heat absorbing members 8032. By arranging the second heat insulating members 8022, it is possible to reduce the amount of heat transfer from the front pad 801 to the second heat absorbing members 8032.

Incidentally, if the second heat insulating members 8022 are too thick, heat accumulated in the fixing belt 60 is not transferred to the second heat absorbing members 8032, so that the temperature of the no-sheet passing portion is more likely to increase. Therefore, it is necessary to optimize the thickness and the length of each of the second heat insulating members 8022 depending on a possible increase in the temperature in the no-sheet passing portion. Nevertheless, the thickness of the each of the second heat insulating members 8022 is smaller than the thickness of each of the first heat insulating members 8021.

The first heat absorbing member 8031 is made of a material, such as metal, with higher thermal conductivity than the middle pad 802 (a second heat transfer unit), extends in the longitudinal direction of the fixing belt 60, and is arranged so as to face the first heat insulating members 8021 and the second heat insulating members 8022.

The middle pad 802 serving as the second layer in contact with the first layer includes the second heat absorbing members 8032 as described above. Therefore, a member is provided to facilitate heat transfer at a certain portion in the axial direction relative to the other portions, in accordance with the position where the temperature of the no-sheet passing portion of the fixing belt 60 increases. Consequently, it is possible to prevent an increase in the temperature of the no-sheet passing portion, and ensure the durability and the temperature stability of the fixing belt 60.

Next, the supporting member 90 that supports the pad 80 will be described.

First, an explanation is given why there is a need to ensure the dimensional accuracy of the supporting member 90 such that the width n of the nip N in the short-side direction of the pad 80 (see FIG. 2) in the case where the pressing roller 70 is pressed against the pad 80 via the fixing belt 60 needs to be constant in the longitudinal direction of the pad 80.

In the fixing operation, if the nip width is short and heat applied to toner is too small, it is difficult to fully fuse the toner, and the toner may not be fixed to a sheet. Conversely, if the nip width is wide and heat applied to toner is too large, the liquidity of the toner excessively increases over a rubbery state, and the toner may not properly be fixed to a sheet. To prevent the issues as described above, it is necessary to prevent variation in the nip width due to various causes.

As a cause of variation in the nip width, the position of the pad 80 as the nip forming member may deviate depending on the dimensional accuracy of the supporting member 90 as the nip supporting member, and this may cause the nip width to vary; therefore, this positional deviation needs to be prevented.

Figure 9A:
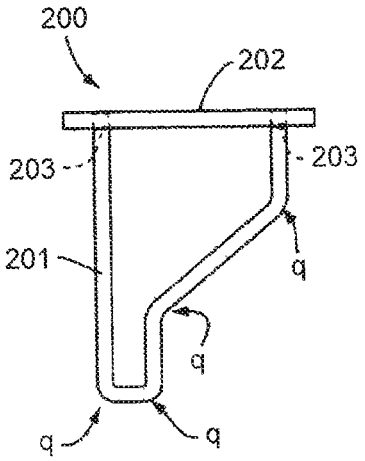
FIG.9A Background Art
FIG. 9A is a side view of a supporting member of a fixing device of a reference example.
Figure 9B:
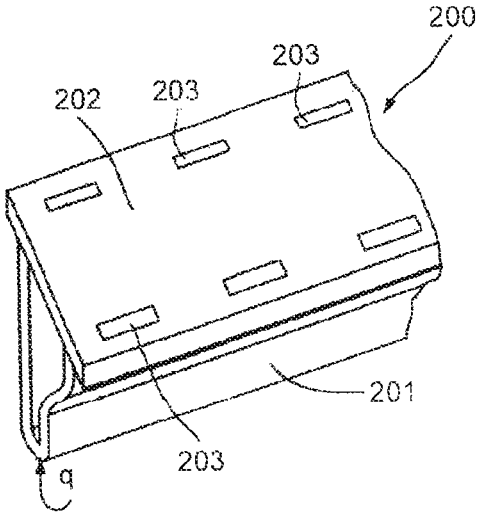
FIG.9B Background Art
FIG. 9B is a partial cutaway perspective view of the supporting member of the fixing device of the reference example.

As a reference example, a conventional supporting member 200 as illustrated in FIGS. 9A and 9B will be described. The conventional supporting member 200 is formed by joining a conventional lower stay 201, which is formed by bending a single plate in an approximately U-shape, to a flat-plate upper stay 202 via swaging parts 203. In this case, the conventional lower stay 201 has a number of bent portions q. Therefore, it is difficult to ensure the dimensional accuracy, and deflection or variation in inclination of a pad attachment surface of the upper stay 202 increases. As a result, the width of the nip N in the short-side side direction of the pad (a lateral direction in FIG. 2) may greatly vary in the longitudinal direction of the pad.

Thus, the supporting member 90 according to the embodiment of the present invention will be described, in which the dimensional accuracy can be ensured to keep the width of the nip N constant along the longitudinal direction of the pad. As illustrated in FIGS. 2 and 7, the attachment holes 53 are formed on the right and left side plates 52 that are fixed to the main body of the apparatus so as to face each other, and the both ends of the supporting member 90 are engaged with the attachment holes 53 to integrally fix the supporting member 90.

The supporting member 90, both ends of which are supported by the right and left side plates 52, is configured to integrally support the pad 80 at a main region thereof in the longitudinal direction as illustrated in FIG. 7, and receive, as a doubly-supported bear, a pressing force Pr applied to the pad 80 from the pressing roller 70 via the fixing belt 60.

Figure 8A:
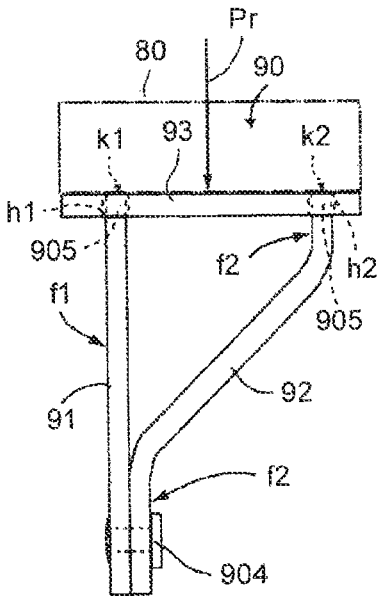
FIG. 8A is a side view of a supporting member used in the fixing device illustrated in FIG. 1.
Figure 8B:
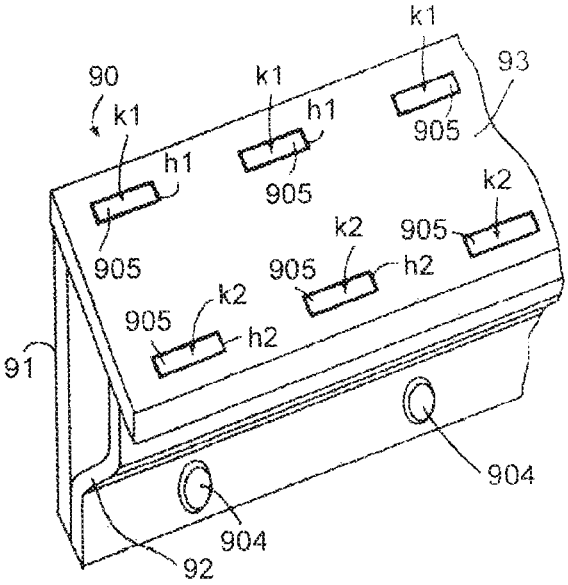
FIG. 8B is a partial cutaway perspective view of the supporting member used in the fixing device illustrated in FIG. 1.

As illustrated in FIGS. 8A and 8B, the supporting member 90 is integrally formed by combining a flat-plate upper stay 91 without bend, which is provided on one side, a curved-plate lower stay 92, and a flat-plate right-hand vertical stay 93 in a triangular shape when viewed from a side (see FIG. 8A). Overlapping ends of the upper stay 91 and the lower stay 92 on the opposite side, which are portions on the side distant from the pad 80 (the nip forming member), are swaged by a swaging bracket (pin) 904.

Further, ends of the upper stay 91 and the lower stay 92 on the pad 80 side are butted to, engaged with, and swaged to the flat-plate right-hand vertical stay 93 via engaging protruding parts 905 in the state in which the upper stay 91 and the lower stay 92 are separated from each other (as indicated by bold lines in FIG. 8B).

Specifically, as illustrated in FIGS. 7, 8A, and 8B, a plurality of the engaging protruding parts 905 protrude from the ends of the two plates, that is, the upper stay 91 and the lower stay 92, on the pad side such that the engaging protruding parts 905 are intermittently arranged in a line along the longitudinal direction of the pad 80. As illustrated in FIG. 8A, the right-hand vertical stay 93 includes a plurality of rectangular through holes h1 and h2 that are arranged at positions facing the upper stay 91 and the lower stay 92 in a linear manner along a direction normal to the sheet of the figure. Further, the engaging protruding parts 905 of the upper stay 91 and the lower stay 92 are inserted in and engaged with the rectangular through holes h1 and h2, so that the engaging protruding parts 905 of the upper stay 91 and the lower stay 92 are fitted to the right-hand vertical stay 93 at a plurality of positions. In this state, assembly is performed such that top surfaces k1 and k2 of the engaging protruding parts 905 and a top surface of the right-hand vertical stay 93 form a single surface, and respective rectangular connection regions are swaged and integrally joined (as indicated by bold lines in FIG. 8B).

In other words, the right-hand vertical stay 93 as a plate with a vertical surface has the rectangular through holes h1 and h2 that are arranged in two parallel lines, and the engaging protruding parts 905 at the ends of the two plates are fitted to the rectangular through holes h1 and h2.

As described above, the engaging protruding parts 905 at the ends of the two plates are fitted to and integrated with the rectangular through holes h1 and h2 of the right-hand vertical stay 93, and in this state, a pressed end surface at the ends can be used as a plane for supporting the pad 80, and the supporting member 90 can function as a leg for supporting the pad 80. Furthermore, a main part of the right-hand vertical stay 93 is a flat plate, and the processing accuracy for this shape can easily be ensured; therefore, positional accuracy of the nip can easily be ensured.

The upper stay 91 has a surface f1 parallel to a direction of a load Pr in the entire area thereof. The lower stay 92 has surfaces f2 parallel to the direction of the load Pr on the end on the pad 80 side and the overlapping end on the opposite side, and has an inclined surface in a middle part thereof. The ends of the upper stay 91 and the lower stay 92 on the pad 80 side are parallel to each other, and joined to the right-hand vertical stay 93 at right angles. The overlapping ends on the opposite side have the parallel surfaces f1 and f2 along the direction of the load Pr, and swaged together with the swaging bracket 904.

Meanwhile, at least a single plate, that is, the upper stay 91, is a flat plate having the simplest form; therefore, it is possible to form the supporting member 90 that can more easily ensure the positional accuracy of the nip.

As described above, the supporting member 90 is formed such that the upper stay 91 and the lower stay 92 are overlapped and integrally joined at the overlapping ends on the opposite side (on the left side in FIG. 2). Further, swaging is performed at a plurality of positions in two portions in an inter-stay direction (a vertical direction in FIG. 2) on the right-hand vertical stay 93 perpendicular to the upper stay 91 and the lower stay 92 (as indicated by bold lines in FIG. 8B).

In this case, an inter-end length of each of the two plates of the supporting member 90 in the short-side direction is set to constant. In this manner, the supporting member 90 is formed in a simple shape, in which an inter-end length L1 of each of the two plates, that is, the upper stay 91 and the lower stay 92, in the short-side direction is set to constant (a lateral direction in FIG. 2), so that it is possible to improve the assembly accuracy of the supporting member 90. In particular, it is possible to fully ensure the assembly accuracy and the coupling rigidity, so that it is possible to fully ensure, as the doubly-supported beam, the geometrical accuracy to prevent bending deflection. Therefore, it is possible to fully prevent displacement of the pad 80 supported by the supporting member 90 at the time of assembly.

Further, in the supporting member 90, not only the two plates, that is, the upper stay 91 and the lower stay 92 (plates), but also the right-hand vertical stay 93 (a plate) having a vertical surface perpendicular to a load applied by a pressing mechanism. Therefore, it is possible to form the supporting member 90, in which the right-hand vertical stay 93 as a plate having the vertical surface perpendicular to a direction of the load Pr has a high geometrical strength, so that it is possible to prevent non-uniformity in the nip width n due to deflection of the supporting member 90.

Furthermore, the two plates, that is, the upper stay 91 and the lower stay 92, of the supporting member 90 are joined together by swaging. Therefore, it is possible to join the two plates, that is, the upper stay 91 and the lower stay 92, at low cost.

As illustrated in FIG. 2, the pad 80 is overlaid on and integrally joined to the right-hand vertical stay 93 of the supporting member 90, and the pad 80 in this state functions to receive the pressing force Pr applied from the pressing roller 70 via the fixing belt.

In this case, the both ends of the supporting member 90 are fitted to the attachment holes 53. In this state, the pressing force Pr from load applying positions g1 (see FIG. 2) of the pad 80 is applied to the ends of the upper stay 91 and the lower stay 92 on the pad 80 side, and the pressing force Pr is transmitted to a load receiving position g2 of the attachment hole 53 from the overlapping ends of the upper stay 91 and the lower stay 92 on the opposite side. In this case, even if the pad 80 receives the pressing force Pr from the pressing roller 70 via the fixing belt, because the supporting member 90 has adequate rigidity, it is possible to prevent positional deviation or bending deflection of the pad 80.

In particular, the surfaces f1 and f2 parallel to the direction of the load Pr applied by the pressing mechanism are provided on the overlapping ends on the opposite side, at which the two plates, that is, the upper stay 91 and the lower stay 92, are joined together. The surfaces f1 and f2 are also provided near contact portions in contact with the end portions on the pad 80 side. In this state, the right-hand vertical stay 93 extending in a direction perpendicular to the surfaces f1 and f2 is provided and the shape is simplified, so that the assembly accuracy can be ensured and the rigidity can be improved. In this regard, it is possible to ensure the accuracy for a constant nip width along the longitudinal direction, as the dimensional accuracy of the nip forming member, while maintaining the strength. Therefore, the nip width between the pressing roller 70 and the pad 80 is set to constant along the longitudinal direction of the pad 80, so that it is possible to resolve a shortage or variation of heat at the time of high-speed rotation, and ensure the high fixing quality even in a high-producing image forming apparatus.

Further, the supporting member 90 fully ensures the strength, maintains a small volume, and has a simple structure. Therefore, in the configuration using the fixing belt 60, the halogen heater 61 can heat the entire belt. In the fixing device 50 including the supporting member 90 as described above, it is possible to reduce the first print time from the heating standby state, resolve a shortage of heat at the time of high-speed rotation, and ensure the high fixing quality even in a high-producing image forming apparatus.

While the embodiments of the present invention have been described above, the present invention is not limited to the embodiments.

Figure 10:
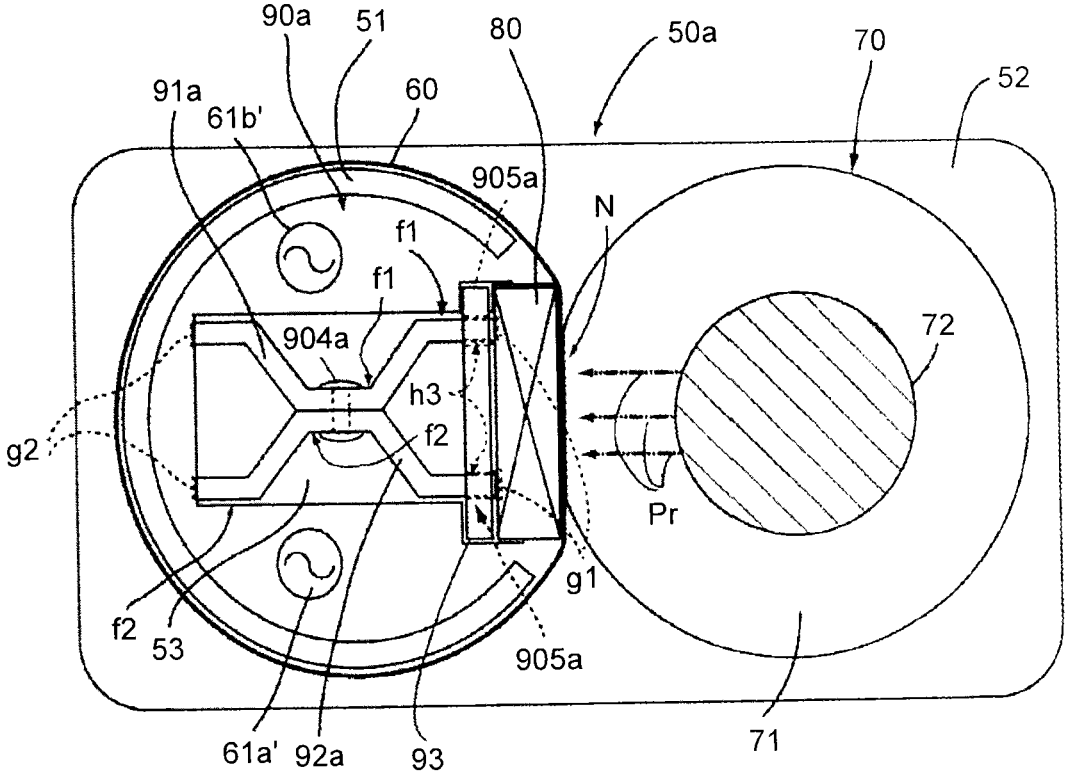
FIG. 10 is an enlarged cross-sectional view schematically illustrating a fixing device of another embodiment of the present invention.

For example, the present invention may be applied to a fixing device 50*a* as illustrated in FIG. 10, and the same advantageous effects as those of the above-described embodiments can be obtained. The fixing device 50*a* differs from the embodiment in that it includes a modified supporting member 90*a* in a different shape from the supporting member 90 of the embodiment, and the other configurations are the same as those of the embodiment; therefore, the same explanation will not be repeated. The modified supporting member 90*a* is configured such that both ends thereof are fitted to the attachment holes 53, and a first stay 91*a* and a second stay 92*a* are assembled in an X-shape when viewed from a side. The first stay 91*a* and the second stay 92*a* have the surfaces f1 and f2 parallel to the direction of the load Pr at both ends and middle parts thereof, and the middle parts are integrated together with a swaging bracket (rivet pin) 904*a*. The same joint portions as described above are provided at a plurality of positions in the longitudinal direction (a direction normal to the sheet of the figure). Further, engaging protruding parts 905*a* of both of the first stay 91*a* and the second stay 92*a* are fitted to opposing rectangular through holes h3 on the pad 80 side and swaged at opposing positions on the respective surfaces.

In this state, the pressing force Pr from the load applying positions g1 on the pad 80 side is applied from a right-hand vertical stay 93*a* to the first stay 91*a* and the second stay 92*a*, and the pressing force Pr is transmitted from respective separate ends on the opposite side to the two load receiving positions g2 of the attachment hole 53. In this case, even if the pressing force Pr from the pressing roller 70 is applied to the pad 80, because the modified supporting member 90*a* supporting the pad 80 has adequate rigidity, it is possible to prevent positional deviation or bending deflection of the pad 80, enabling to prevent variation in the nip width.

In this case, it may be possible to provide halogen heaters 61*a*' and 61*b*' as heat sources above and below the modified supporting member 90*a* in a distributed manner as illustrated in FIG. 10. The central heater 61*a* and the end heater 61*b* of the embodiment can be employed as the halogen heaters of this example. It may be possible to simplify the configuration by providing a single halogen heater depending on cases.

Figure 11:
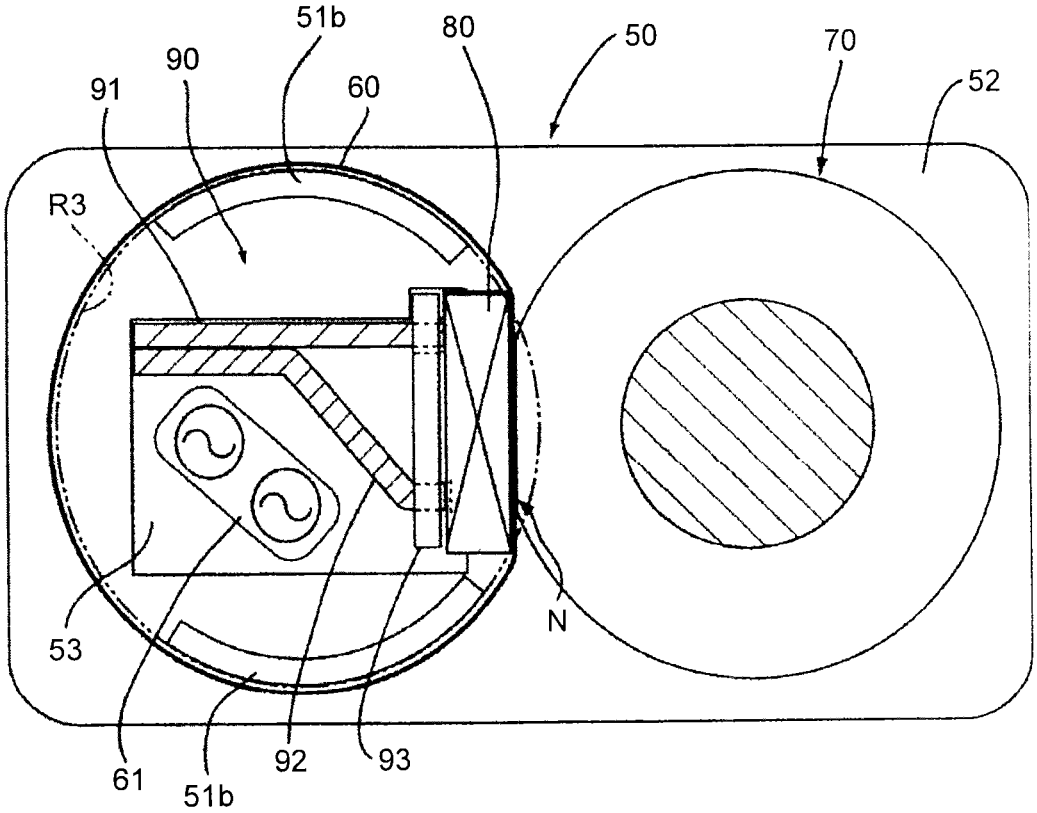
FIG. 11 is an enlarged cross-sectional view schematically illustrating a fixing device of still another embodiment of the present invention.
Figure 12:
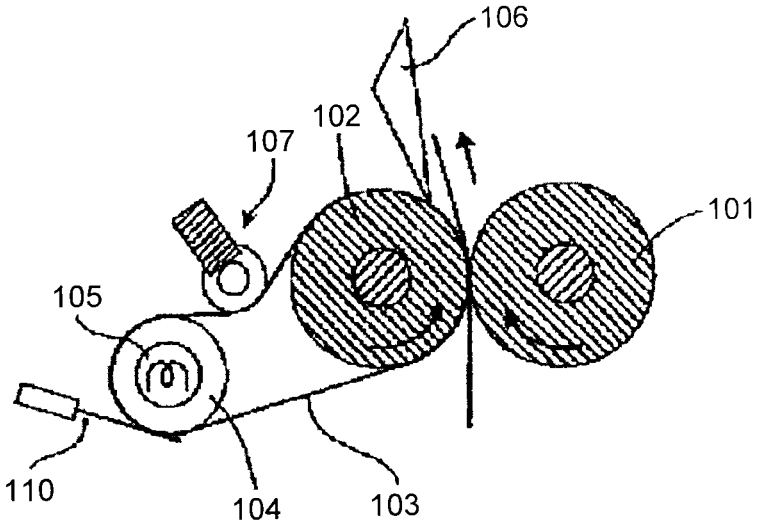
FIG. 12 is a diagram for explaining a conventional fixing device.

While the holders 51 in cutaway ring shapes are used in the fixing device of the embodiment as described above, it may be possible to simplify the shape by providing a plurality of flake-shaped holders 51*b* along a rotation trajectory R1 on the inner circumferential wall of the fixing belt to rotatably support the fixing belt as illustrated in FIG. 11. Even in this case, the same advantageous effects as those of the embodiment can be obtained.

In the fixing device 50 illustrated in FIG. 2 the upper stay 91 and the lower stay 92 of the supporting member 90 are swaged together at the end portions on the pad 80 side and the overlapping ends on the opposite side by using the swaging bracket 904, and the end portions on the pad 80 side are butted and swaged to the right-hand vertical stay 93. The upper stay 91, the lower stay 92, and the right-hand vertical stay 93 may be welded together instead of swaging. In this case, it is possible to improve the strength of the joints of the supporting member 90, so that the supporting member 90 that is less likely to be deflected can be generated.

According to the image forming apparatus 10 as the color printer as described above, by using the fixing device 50, it is possible to use the supporting member 90 capable of ensuring the accuracy with reduced processing difficulty. Therefore, it is possible to stabilize the positional accuracy of the nip at lower cost, enabling to realize an image forming apparatus capable of realizing the same advantageous effects as those of the fixing device 50.

For example, while the fixing device to which the present invention is applied is installed in the image forming apparatus that is a color printer, the image forming apparatus is not limited to the above-described type, and other types of image forming apparatuses may be employed. Further, the image forming apparatus to which the present invention is applied may be a copier, a facsimile machine, or a multi-function peripheral having a plurality of mechanisms of a copier, a facsimile machine, and the like. Furthermore, the image forming apparatus to which the present invention is applied may be an image forming apparatus used to form electrical circuits, or an image forming apparatus used to form predetermined images in the field of biotechnology. The advantageous effects described in the embodiments of the present invention are preferred ones derived from the disclosed technology, and are not limited to those described herein.

According to the embodiments of the present invention, a nip supporting member is configured by joining two or more plates together to realize a simple shape, so that it is possible to ensure the accuracy while maintaining the strength. Therefore, it is possible to easily ensure the positional accuracy of a nip by the nip supporting member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing belt;

a fixing belt holder that holds both ends of the fixing belt;

a pressing member that comes in contact with an outer circumferential surface of the fixing belt;

a nip forming member that is arranged inside the fixing belt, and forms a nip by coming in contact with the pressing member via the fixing belt;

a nip supporting member that supports the nip forming member;

a side plate to which the fixing belt holder and the nip supporting member are fixed; and a pressing mechanism that presses the pressing member against the nip forming member via the fixing belt, wherein the nip supporting member includes at least two plates, the two plates are separated from each other near a contact portion where the two plates come in contact with the nip forming member, at least a part of each of the two plates is a flat surface parallel to a direction of a load applied by the pressing mechanism, portions of the two plates on a side distant from the contact portion are joined together, and at least one of the two plates includes parallel unbent ends that are opposite one another along the direction of the load.

2. The fixing device according to claim 1, wherein one of the two plates of the nip supporting member is a flat plate without bend.

3. The fixing device according to claim 1, wherein an inter-end length of each of the two plates of the nip supporting member in a short-side direction of each of the two plates is constant.

4. The fixing device according to claim 1, wherein the nip supporting member further includes a plate, which includes a vertical surface perpendicular to the direction of the load applied from the pressing member and which is joined to the two plates, in addition to the two plates.

5. The fixing device according to claim 4, wherein the plates of the nip supporting member are formed by punching an iron steel plate.

6. The fixing device according to claim 4, wherein the plate including the vertical surface includes holes, to which end portions of the two plates are fitted.

7. The fixing device according to claim 5, wherein the plate including the vertical surface includes holes, to which end portions of the two plates are fitted.

8. The fixing device according to claim 1, wherein the two plates of the nip supporting member are swaged together.

9. The fixing device according to claim 1, wherein the plates of the nip supporting member are welded together.

10. An image forming apparatus comprising the fixing device according to claim 1.

11. The fixing device according to claim 1, wherein the at least two plates are separately formed plates.

12. The fixing device according to claim 1, wherein the portions of the two plates on the side distant from the contact portion include inner surfaces in contact with each other and are joined together.

* * * * *